US005679106A

United States Patent [19]

Ohno et al.

[11] Patent Number: 5,679,106

[45] Date of Patent: Oct. 21, 1997

[54] ROLLER FOR FORMING CORRUGATED FIN

[75] Inventors: Tetuo Ohno; Hisashi Kobayashi, both of Kariya, Japan

[73] Assignee: Nippondenso Co., Ltd., Kariya, Japan

[21] Appl. No.: 580,099

[22] Filed: Dec. 22, 1995

[30] Foreign Application Priority Data

Dec. 26, 1994 [JP] Japan ..... 6-322880
Oct. 4, 1995 [JP] Japan ..... 7-257525

[51] Int. Cl.[6] ..... B23P 15/00

[52] U.S. Cl. ..... 492/1; 492/30; 29/727

[58] Field of Search ..... 29/727; 492/30, 492/1; 72/182, 183, 199, 366

[56] References Cited

U.S. PATENT DOCUMENTS 1,936,228 11/1933 Crafton ..... 492/1
2,769,479 11/1956 Getz ..... 492/1
3,789,786 2/1974 Wedenmann et al. ..... 29/727
3,998,600 12/1976 Wallis .
4,597,277 7/1986 Emieu ..... 492/1

FOREIGN PATENT DOCUMENTS 0 641 615 3/1995 European Pat. Off. .
55-110892 8/1980 Japan .
6-347184 12/1994 Japan .
7-080558 3/1995 Japan .
2 252 069 7/1992 United Kingdom .

*Primary Examiner*—Irene Cuda
*Attorney, Agent, or Firm*—Cushman, Darby & Cushman IP Group of Pillsbury Madison & Sutro LLP

[57] ABSTRACT

To produce a corrugated fin suitably used to fabricate heat exchangers such as radiators, condensers of the air conditioners, etc., for automobiles, a toothed roller for forming a corrugated fin has circumferential teeth comprising a tooth tip having a concavity, a tooth bottom having a convexity, and a tooth slope having a louver cutting edge between the tooth tip and the tooth bottom, wherein a top of the convexity of the tooth bottom is located at a forward offset from a center line of the tooth bottom with respect to a direction of rotation of the roller.

3 Claims, 5 Drawing Sheets

ROLLER FOR FORMING CORRUGATED FIN

BACKGROUND OF THE INVENTION

1. Field of the Invention

The present invention relates to a process and a roller for forming a corrugated fin suitably used to fabricate heat exchangers such as radiators, condensers of the air conditioners, etc., for automobiles.

2. Description of the Related Art

Conventionally, the corrugated fin of a heat exchanger was usually formed to have bent portions in an arc form, which had a problem in fabrication that the bent portions are in contact with flat tubes on both sides in a small area, causing both reduction in heat condition and increase in the resistance to an air flow through the fin.

To solve this problem, Japanese Unexamined Patent Publication (Kokai) No. 55-110892 proposed a corrugated fin having a flat bent portion. As shown in FIG. 1, a pair of toothed rollers provided with circumferential teeth having a tooth tip concavity 21 and a tooth bottom convexity 22 are engaged with each other and are rotated to effect a press forming of a fin material directed therebetween. The tooth tip concavity 21 is made in an arc form having a selected radius "r". A louver cutting edge 23 is provided entirely over a slope between the tooth tip concavity 21 and the tooth bottom convexity 22.

The proposed forming roller 20, however, has a problem that, as shown in FIG. 2, folds 261 and 262 at both ends of a flat bent portion 26 of a formed corrugated fin 25 are different in radius, causing an inclination of the flat bent portion 26, which again fails to provide a sufficient contact area between the fin and flat tubes attached to the fin on both sides.

Referring to FIG. 3, a pair of forming rollers 20 and 20 are fittingly engaged with each other and rotated in the direction shown by a pair of arrows to effect forming of a fin material W directed therebetween. When the fin material W is located between the tooth tip concavity 21 and the tooth bottom convexity 22, a portion "a" of the fin material W is pushed upward by the tooth bottom convexity 22 to produce a large tensile force, and therefore, the portion "a" is subjected to a strong burnishing or rubbing effect. At the same time, louvers have been already cut by the louver cutting edge 23 in a portion "b" of the fin material W while, in a portion "c", the fin material W is still on the louver cutting edge and louvers have not yet been cut.

Then, referring to FIG. 4, in a portion "d", louvers have been already cut and the fin material W is retracted with the result that the tensile force is relieved and the burnishing effect by the tooth bottom convexity 22 is mitigated.

Thus, between the tooth tip concavity 21 and the tooth bottom convexity 22, the fin material W is subjected to a strong burnishing effect only in the forward side portion (in the right side portion in FIGS. 3 and 4). The flat bent portion is formed under the tensile force exerted on the fin material W, in which the portion "b" is bent by the slope surface of the roller 20 whereas the portion "c" is bent on the louver cutting edge. In the thus-formed corrugated fin, the flat bent portion has shoulders having different radii of curvature such that the forward side shoulder is greater in radius than the backward side shoulder with respect to the direction of rotation of the roller 20, causing the problem that the corrugated fin 25 has an inclined flat bent portion 26 as shown in FIG. 2.

To solve this problem, Japanese Patent Application No. 5-223696 by the present inventors proposed that the tooth tip concavity has a greater radius in the forward side arc portion in comparison with that of the backward side arc portion.

In the proposed arrangement, when a flat bent portion is formed by directing a fin material between a tooth tip concavity and a tooth bottom convexity, the fin material is subjected to the burnishing effect in an approximate middle portion, not in the forward side portion, because the tooth tip concavity has a greater radius in the forward side arc portion than in the backward side arc portion. This substantially equalizes the radius of curvature of the fold in both shoulders of the flat bent portion of a corrugated fin.

In the proposed forming roller, a symmetrical flat bent portion can be formed when a corrugated fin has a relatively large fin pitch and a sufficiently wide flat portion as shown in FIG. 5. However, there is a problem that, when a corrugated fin has a reduced fin pitch, the flatness of the flat surface of the flat bent portion is degraded.

SUMMARY OF THE INVENTION

An object of the present invention is to solve the above-mentioned problem and thereby provide a process and a forming roller which are able to form a corrugated fin having good shape, particularly a flat bent portion having a good flatness.

Another object of the present invention is to provide a forming roller which is able to form a corrugated fin having a flat bent portion in which both shoulders have substantially the same radius of curvature.

To achieve the object according to the present invention, there is provided a toothed roller for forming a corrugated fin, the roller having circumferential teeth comprising a tooth tip having a concavity, a tooth bottom having a convexity, and a tooth slope having a louver cutting edge between the tooth tip and the tooth bottom, wherein:

a top of the convexity of the tooth bottom is located at a forward offset from a center line of the tooth bottom with respect to a direction of rotation of the roller.

To form a corrugated fin using the roller according to the present invention, a fin material of a metal sheet is directed between a pair of rollers which are engaged with each other and are rotated. A tooth tip of one roller and a tooth bottom of the other roller are fittingly engaged with each other, the fin material is directed between the tooth tip and the tooth bottom to form a corrugated fin with louvers cut therein by a louver cutting edge provided on a slope of the tooth.

The tooth tip concavity and the tooth bottom convexity are fittingly engaged with each other, nipping a fin material to form a flat bent portion. When a corrugated fin having a relatively small fin pitch is formed, the portion of the fin material bridging the top of the forward end elevation and the louver cutting edge is longer than the tooth top concavity, so that, if the top of the tooth bottom convexity is located on the center line of the tooth bottom as in the conventional process, the top of the tooth bottom convexity is brought into contact with the fin material at a position out of the center of the flat bent portion.

In the forming roller according to the present invention, the top of the tooth bottom convexity is located at a forward offset from the center line of the bottom convexity with respect to the direction of rotation of the roller, so that the position at which the fin material is pushed up by the tooth bottom convexity is shifted forward in the direction of rotation of the roller, i.e., the portion of the fin material bridging the tooth tip concavity and the tooth bottom convexity is bent by the tooth bottom convexity approximately at the center thereof.

Preferably, the concavity of the tooth tip has a backward end elevation higher than a forward end elevation thereof. This enables that the forward end and the backward end of the tooth tip concavity have appropriately different heights to form a sufficient degree of dent in the bent portion to provide approximately the same radius at both shoulders of the flat bent portion.

This provides a corrugated fin with a good shape having no inclination of the flat bent portion.

DESCRIPTION OF THE PREFERRED EMBODIMENTS

Figure 6:
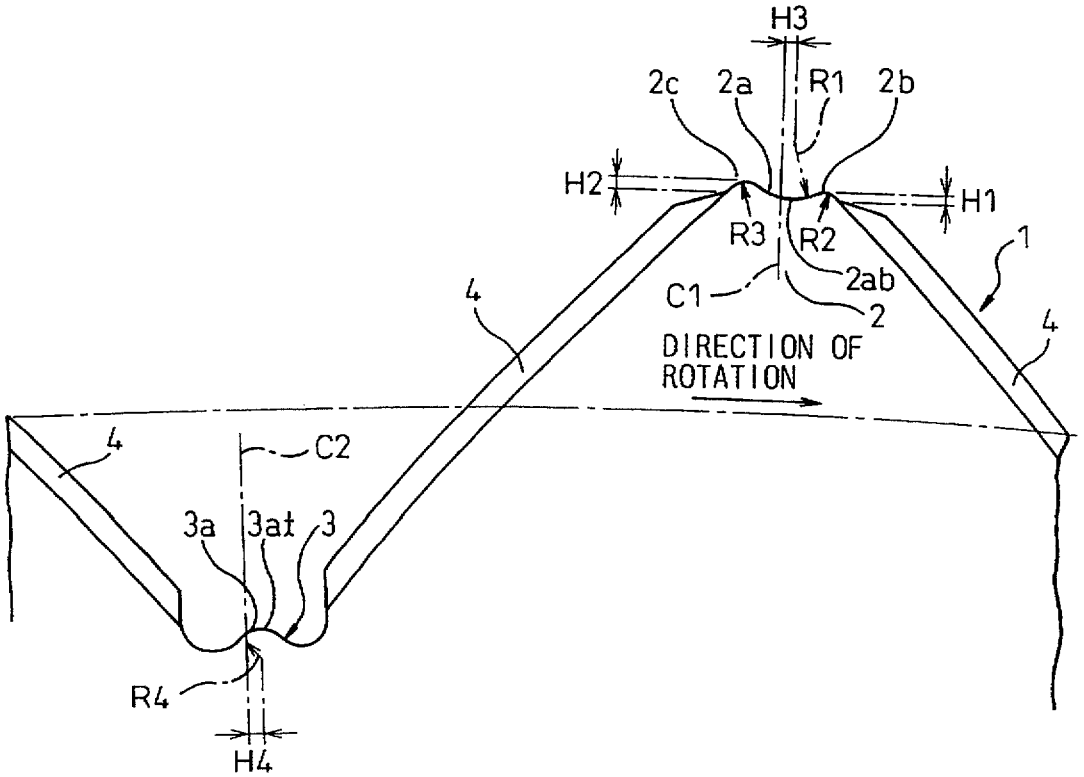
FIG. 6 is an enlarged partial front view of a forming roller according to the present invention.

FIG. 6 is an enlarged partial front view of a forming roller 1 for forming a corrugated fin according to the present invention. The forming roller 1 is made of a high speed steel, has a diameter of about 12 cm, and is substantially produced by alternately providing tooth tips 2 and tooth bottoms 3 on the circumference and machining a helical louver cutting edge 4 on a slope between the tooth tip 2 and the tooth bottom 3. Plural forming rollers in the form of a disc several mm thick are laminated to a thickness corresponding to the width of the fin material W.

A tooth tip concavity 2*a* is provided on the tooth tip 2 and a tooth bottom convexity 3*a* is provided on the tooth bottom 3. As can be seen from FIG. 6, the tooth tip concavity 2*a* has a radius of curvature R1 and the lowest point 2*ab* of the tooth tip concavity 2*a* is located at a forward offset H3 from a center line C1 of the tooth tip 2 with respect to the direction of rotation of the roller 1.

Thus, a backward end elevation 2*c* of te concavity 2*a* has a height H2 greater than a height H1 of a forward end elevation 2*b* of the concavity 2*a*. The tooth bottom convexity 3*a* has a radius of curvature R4 in the upper portion and a top 3*at* of the convexity 3*a* is located at a forward offset H4 from a center line C2 with respect to the direction of rotation of the roller 1.

The forward end elevation 2*b* of the tooth tip concavity 2*a* has a radius R2 smaller than a radius R3 of the backward end elevation 2*c* of the concavity 2. The louver cutting edge 4 is formed on the forward side slope at a distance H1 from a top of the forward end elevation 2*b* of the tooth tip 2 and the louver cutting edge 4 is formed on the backward side slope at a distance H2 from a top of the backward end elevation 2*c* of the tooth tip 2.

More specifically, in a forming roller for forming a corrugated fin having a fin pitch of 2 mm and a louver distortion angle of 20°, for example, the forward end elevation 2*b* of the tooth tip 2 has a radius R2 of 0.1 mm, the backward end elevation 2*c* has a radius R3 of 0.14 mm, the arc portion of the tooth tip concavity 2*a* has a radius R1 of 0.4 mm, the arc portion of the tooth bottom convexity 3*a* has a radius R4 of 0.2 mm, the lowest point 2*ab* of the tooth tip concavity 2*a* has a forward offset H3 of 0.1 mm from the center line C1 of the tooth tip 2, the top 3*at* of the tooth bottom convexity 3*a* has a forward offset of 0.1 mm from the center line C2 of the tooth bottom 3, the forward end elevation 2*b* of the tooth tip 2 is located at a distance H1 of 0.05 mm from the tooth tip side end of the louver cutting edge 4 provided on the forward side slope, and the backward end elevation 2*c* of the tooth tip 2 is located at a distance H2 of 0.1 mm from the tooth tip side end of the louver cutting edge 4 provided on the backward side slope.

As can be seen from FIG. 6, the forward offset H3 of the lowest point 2*ab* from the center line C1 and the forward offset H4 of te top 3*at* from the center line C2 are increased as the louver distortion angle and the fin pitch are increased.

To form a corrugated fin by using the above-described arrangement, a fin material W of a metal sheet is directed between a pair of forming rollers 1 which are engaged with each other and are rotated. The fin material is composed of a sheet of aluminum or copper. The aluminum sheet typically has a thickness of about 0.05 mm to about 0.15 mm. The fin material is directed at a speed such that 3,000 to 18,000 louvers are formed in one minute.

The tooth tip 2 of one roller 1 and the tooth bottom 3 of the other roller 1 are engaged with each other to nip the fin material W, thereby cutting louvers by the louver cutting edge 4 provided on the slope while forming a corrugated fin by the nip between the tooth tip 2 and the tooth bottom 3.

Figure 7:
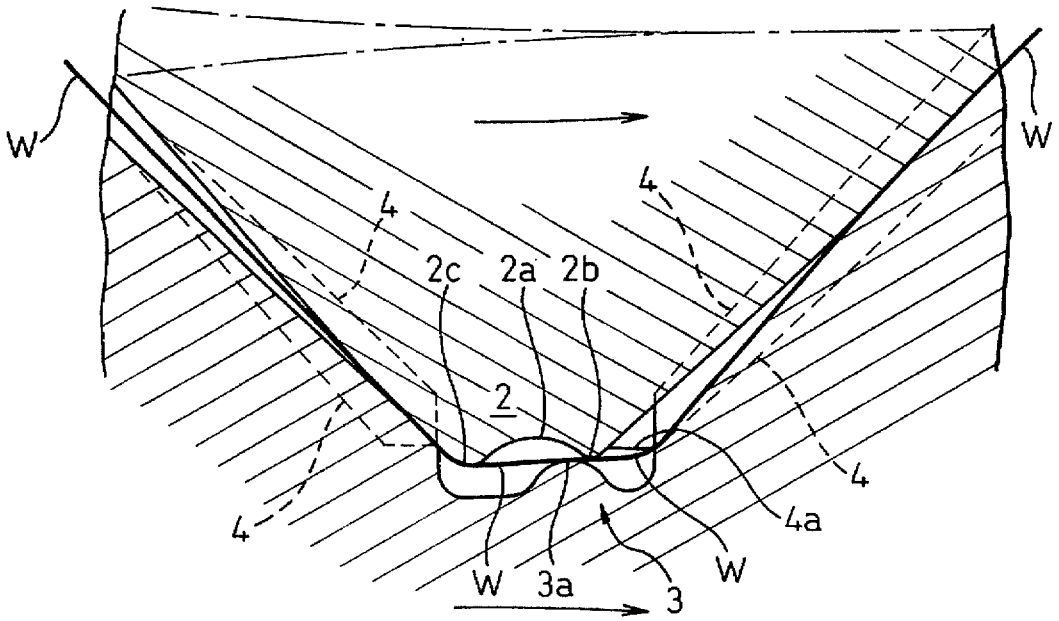
FIG. 7 is an enlarged partial sectional view of a pair of forming rollers engaged with each other, according to the present invention.
Figure 8:
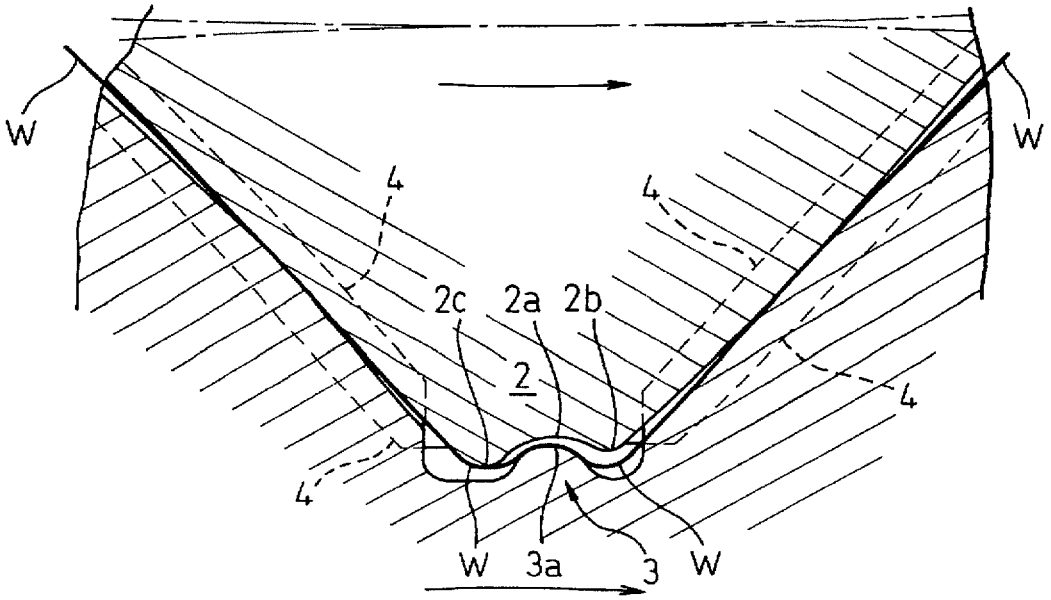
FIG. 8 is an enlarged partial sectional view of a pair of forming rollers in a forming phase next to that shown in FIG. 7.

Referring to FIGS. 7 and 8, the concavity 2*a* of the tooth tip 2 and the convexity 3*a* of the tooth bottom 3 are engaged with each other and nip the fin material W to form the flat bent portion of a corrugated fin. As shown in FIG. 6, the top 3*at* of the tooth bottom convexity 3*a* is located at a forward offset H4 from the center line C2 with respect to the direction of rotation of the forming roller, so that the point at which the fin material is pushed upward by the tooth bottom convexity 3*a* is located at a forward offset with respect to the direction of rotation of the forming roller, and therefore, the portion of the fin material W bridging the tooth tip concavity 2*a* and the tooth bottom convexity 3*a* is subjected to a burnishing effect in an approximately middle region as can be seen from FIG. 8, but not in a backward region.

The effect of the offset of the convexity 3*a* of the tooth bottom 3 will be described below.

Figure 9:
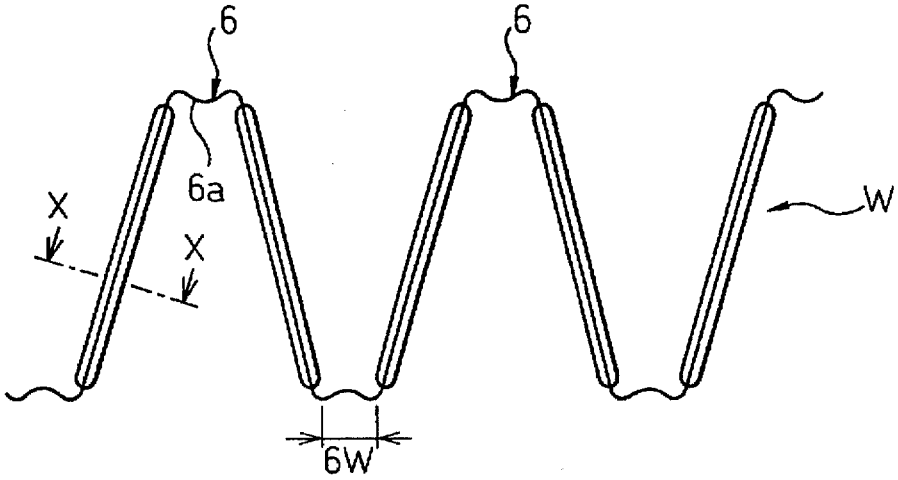
FIG. 9 is a front view of a fin material having passed between forming rollers.

FIG. 7 shows a forming process in a phase in which the louver cutting edge 4 is cutting a louver and the fin material W in the tooth bottom 3 is nipped by a tooth tip-side end 4*a* of the cutting edge 4 provided on the forward side slope, the tooth bottom convexity 3*a*, and the backward end elevation 2*c* of the tooth tip concavity 2. In the next phase shown in FIG. 8, the tooth bottom convexity 3*a* is fittingly engaged with the tooth tip concavity 2*a* to form a bent portion 6 in the form of a rounded "W" having a dent 6*a* (FIG. 9) corresponding to the tooth bottom convexity 3*a*.

Figure 5:
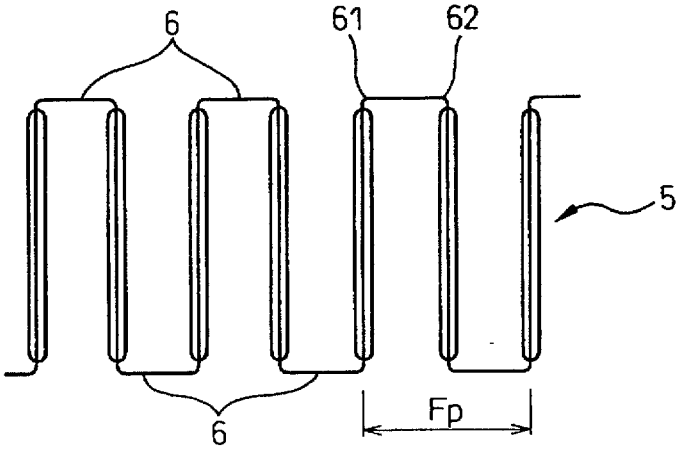
FIG. 5 is a front view of a formed corrugated fin.

To provide a final flat shape of the bent portion 6 as shown in FIG. 5, the bent 6*a* is preferably located at a center of the bent portion 6 when it leaves the forming rollers 1, 1. In a corrugated fin having a large fin pitch and a large width 6*w* of the bent portion 6*a*, it does not matter if the dent 6*a* is located out of the center of the bent portion 6. However, in a corrugated fin having a small fin pitch and a small width 6*w* of the bent portion 6, if the dent 6*a* is located out of the center, the shoulders 61 and 62 (FIG. 5) of the bent portion 6 have different radii, and in an extreme case, the bent portion 26 is inclined.

The inventors found that the dent 6*a* is prevented from being out of the center of the bent portion 6, if the tooth bottom convexity 3*a* is brought into contact with an approximately middle point of the bent portion 6 of the fin material W, as shown in FIG. 7.

Figure 1:
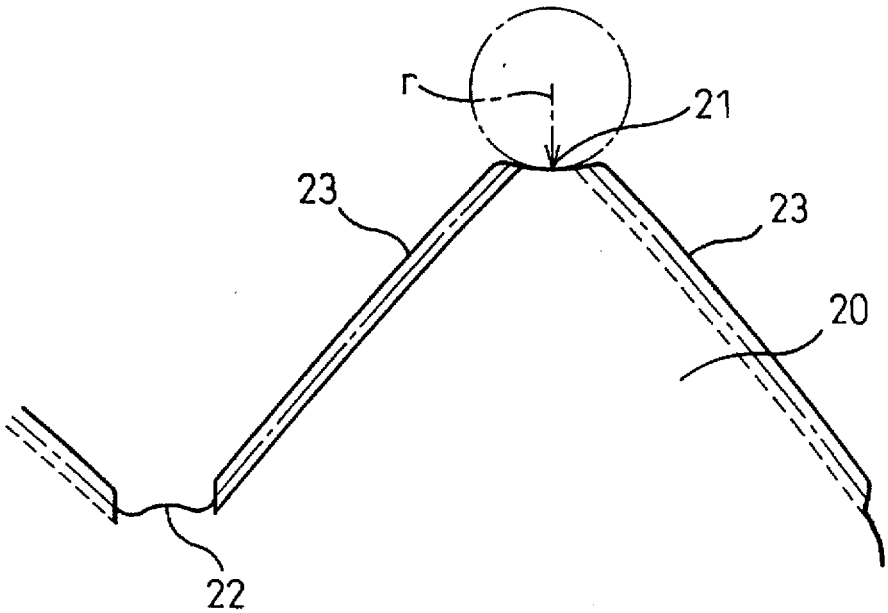
FIG. 1 is an enlarged partial front view of a conventional forming roller.
Figure 2:
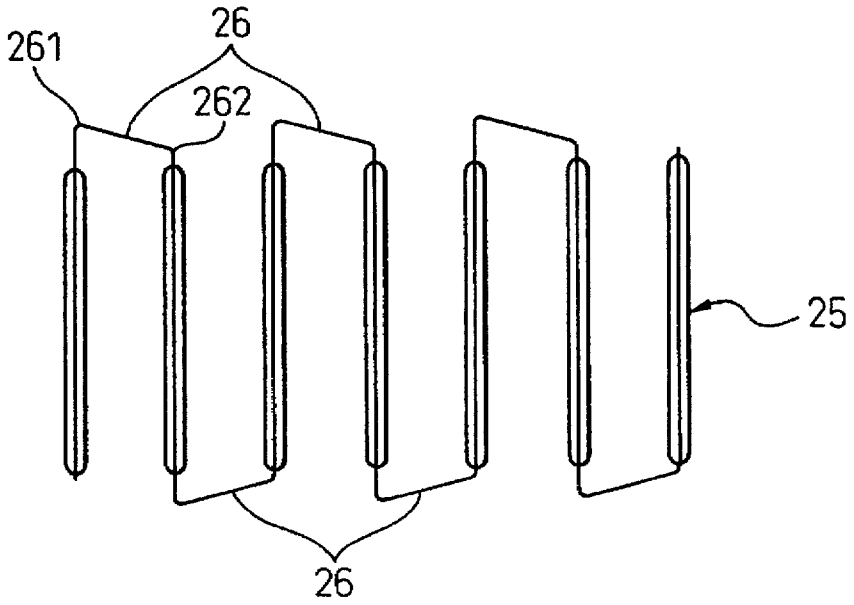
FIG. 2 is a front view of a corrugated fin formed by a conventional process.
Figure 3:
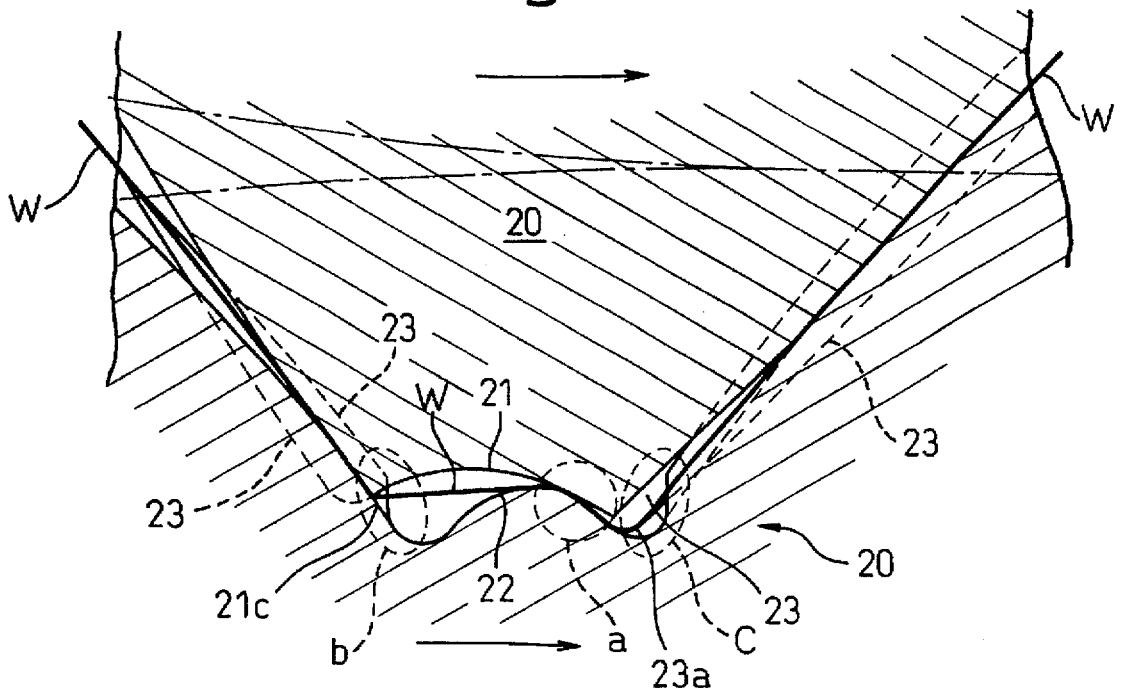
FIG. 3 is an enlarged partial sectional view of a pair of conventional forming rollers engaged with each other.
Figure 4:
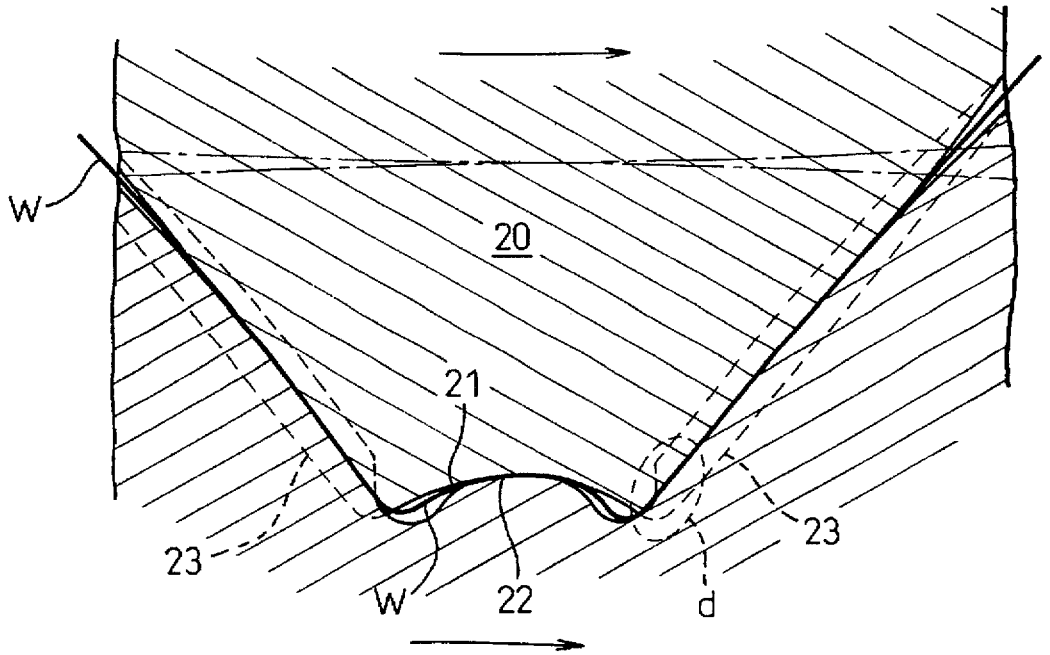
FIG. 4 is an enlarged partial sectional view of a pair of conventional forming rollers engaged with each other in a forming phase next to that shown in FIG. 3.

In the conventional forming roller as shown in FIG. 1, the tooth bottom convexity 22 is located on the center line of the tooth bottom, so that the tooth bottom convexity 22 is brought into contact with the fin material W in an approximately middle point of the bent portion bridging the corner 23*a* of the cutting edge 23 and the backward end elevation 21*c* of the tooth tip concavity 21 as shown in FIG. 3.

In the present invention, the tooth bottom convexity 3*a* is located at a forward offset from the center line of the tooth bottom with respect to the direction of rotation of the roller 20 as shown in FIGS. 7 and 8, so that the tooth bottom convexity 3*a* is brought into contact with the fin material in an approximately middle point between the corner 4*a* of the cutting edge and the backward end elevation 2*c* of the tooth tip concavity 2. Thus, the dent 6*a* is formed in an approximate middle of the bent portion 6 during bending of the fin material W.

As shown in FIG. 6, the lowest point 2*ab* of the tooth tip concavity 2*a* is located at a forward offset H3 from the center line C1 with respect to the direction of rotation of the roller, so that the height H2 of the backward end elevation 2*c* of the tooth tip concavity 2*a* is greater than the height H1 of the forward end elevation 2*b* to form a sufficient degree of dent 6*a* (FIG. 9) in the bent portion 6 to finally provide approximately the same radius of both shoulders 61 and 62 (FIG. 5) of the flat bent portion 6.

This operation is also described in Japanese Patent Application No. 5-223696 by the present inventors. Because of the difference between the heights H1 and H2 of the end elevations 2*b* and 2*c*, the bending of the fin material is not completed in a forward side region when the fin material is subjected to the burnishing effect and the forming of the bent portion 6 is performed in the region between the forward end elevation 2*b* and the corner 4*a* of the louver cutting edge 4, so that forces exerted on the fin material in forward and backward regions are approximately equalized.

As can be seen from the above description, to locate the tooth bottom convexity 3*a* at the center of the bent portion 6, an important matter is the distance between the corner 4*a* of the louver cutting edge 4 and the backward end elevation 2*c* of the tooth tip concavity 2*a*, particularly the distance between the corner 4*a* of the louver cutting edge 4 and the forward end elevation 2*b* of the tooth tip concavity 2*a*. Therefore, the offset H4 of the tooth bottom convexity 3*a* must be determined based on this distance.

Figure 10:
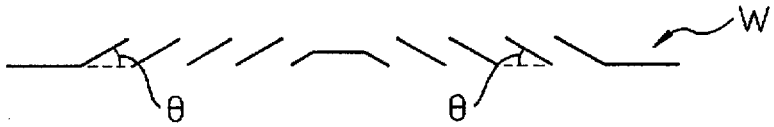
FIG. 10 is a sectional view along the line X—X in FIG. 9.

It should be noted that the distance between the corner 4*a* of the cutting edge 4 and the backward end elevation 2*c* corresponds to the width 6*w* of the bent portion 6 of the fin material and the width 6*w* is related to the fin pitch Fp (FIG. 5). It should also be noted that the distance between the corner 4*a* of the cutting edge 4 and the forward end elevation 2*b* is related to the louvering amount, which is related to the louver distortion angle θ (FIG. 10).

Figure 11:
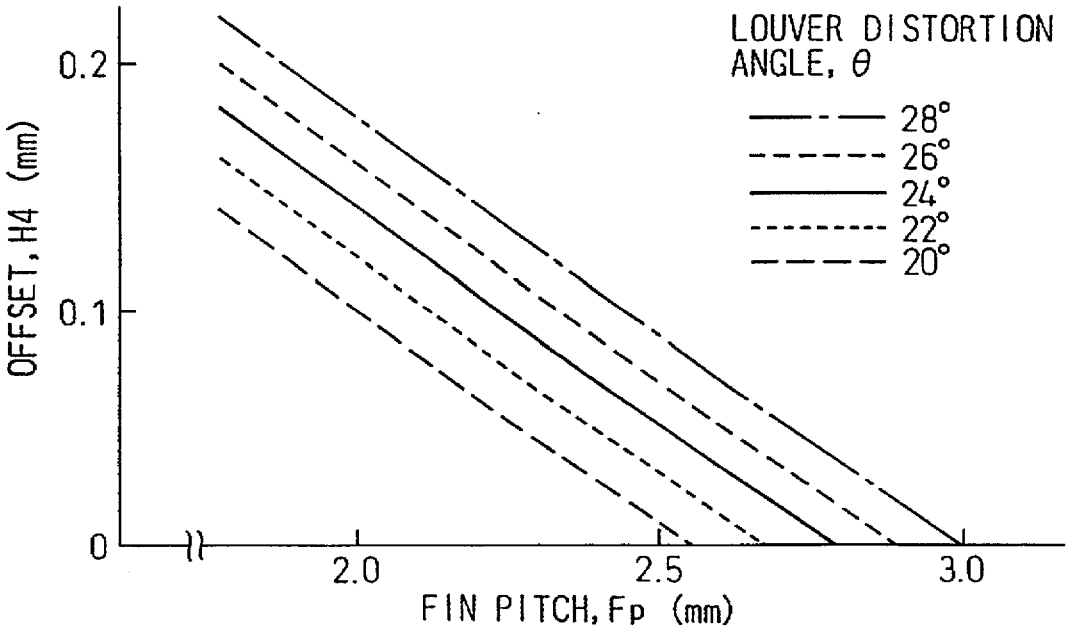
FIG. 11 is a graph showing the relationships between the fin pitch, the offset, and the louver distortion angle.

Therefore, an appropriate value of the offset H4 of the tooth bottom convexity 3*a* can be determined by using the fin pitch Fp and the louver distortion angle θ as parameters. FIG. 11 is a graph showing the offset H4 as a function of the fin pitch Fp and the louver distortion angle θ. As can be seen from FIG. 11, although small offsets H4 may be appropriate when the fin pitch Fp is large, a large offset H4 is required when the fin pitch Fp is small, for example, the top 3*at* of the tooth bottom convexity 3*a* must have an offset H4 of about 0.1 mm when the fin pitch is as small as 2 or 3 mm for a louver distortion angle θ of 24°.

In the above-described example, the difference between the heights H1 and H2 of the forward and backward end elevations 2*b* and 2*c* of the tooth tip concavity 2 is produced by the forward offset H3 of the center of the radius R1. However, it can be easily recognized by a person skilled in the art that the difference between the heights H1 and H2 may otherwise be produced. For example, as disclosed in Japanese Patent Application No. 5-223696 by the present inventors, the difference between the height H1 and H2 may be produced by a difference in radius between forward and backward halves of the tooth tip concavity 2.

We claim:

1. A toothed roller for forming a corrugated fin, the roller having circumferential teeth comprising a tooth tip having a concavity, a tooth bottom having a convexity, and a tooth slope having a louver cutting edge between the tooth tip and the tooth bottom, wherein:

a top of the convexity of the tooth bottom is located at a forward offset from a center line of the tooth bottom with respect to a direction of rotation of the roller.

2. A toothed roller according to claim 1, wherein the concavity of the tooth tip has a backward end elevation higher than a forward end elevation thereof.

3. A toothed roller according to claim 2, wherein the concavity of the tooth tip has a fixed radius of curvature having a center located at a forward offset from a center line of the tooth tip with respect to the direction of rotation of the roller.

* * * * *